US005797311A

United States Patent [19]

Gasthuber et al.

[11] Patent Number: 5,797,311

[45] Date of Patent: Aug. 25, 1998

[54] PISTON/LINER ARRANGEMENT FOR A RECIPROCATING-PISTON INTERNAL COMBUSTION ENGINE

[75] Inventors: Herbert Gasthuber, Ulm; Bernd-Eric Lübbing, Ebersbach; Martin Schulz, Plochingen; Michael Wiesner, Fellbach, all of Germany

[73] Assignee: Daimler Benz AG, Stuttgart, Germany

[21] Appl. No.: 889,699

[22] Filed: Jul. 8, 1997

[30] Foreign Application Priority Data

Jul. 8, 1996 [DE] Germany ..... 196 27 418.4

[51] Int. Cl.[6] ..... F01B 31/10

[52] U.S. Cl. ..... 92/158; 92/153; 92/170.1; 184/18

[58] Field of Search ..... 92/153, 155, 158, 92/159, 160, 169.1, 170.1; 123/196 R; 184/18

[56] References Cited

U.S. PATENT DOCUMENTS

| | | | |
|---|---|---|---|
| 3,749,072 | 7/1973 | Schweikher | 92/169.1 |
| 4,526,484 | 7/1985 | Stahl et al. | 384/133 |
| 4,527,805 | 7/1985 | Gowda et al. | 277/80 |
| 4,598,675 | 7/1986 | Long | 123/90.57 |
| 4,846,051 | 7/1989 | Wade . | |

FOREIGN PATENT DOCUMENTS

| | | |
|---|---|---|
| 0 330 323 | 8/1989 | European Pat. Off. . |
| 0 400 334 | 12/1990 | European Pat. Off. . |
| 2 274 145 | 7/1994 | United Kingdom . |
| WO 86/01272 | 2/1986 | WIPO . |

OTHER PUBLICATIONS

Commercial Application of Ferrofluids, By K. Ray and R. Moskowitz, Journal of Magnetism and Magnetic Materials 85 (1990) 233–245, North–Holland.

*Primary Examiner*—Thomas E. Denion
*Attorney, Agent, or Firm*—Klaus J. Bach

[57] ABSTRACT

In a piston/liner arrangement for a reciprocating-piston internal combustion engine, wherein a piston with a skirt is axially movable in the liner, at least one of the piston skirt and the liner includes sections with an open-pore surface structure in which a lubricant with a high affinity to the material having the open-pore surfaces structure is disposed so as to form a lifetime lubrication arrangement.

2 Claims, 1 Drawing Sheet

PISTON/LINER ARRANGEMENT FOR A RECIPROCATING-PISTON INTERNAL COMBUSTION ENGINE

BACKGROUND OF THE INVENTION

The invention relates to a piston/liner arrangement for a reciprocating-piston internal combustion engine with a piston liner in which a piston is axially movably disposed and a lubricating system for lubricating the piston in the piston liner.

With conventional piston/liner arrangements of this kind, the lubrication system for the friction pair formed by the piston skirt, on the one hand, and the cylinder liner, on the other hand, is part of an engine lubrication circuit, the lubricant for the piston/liner unit being for example added to the fuel or introduced from outside through the cylinder liner. In the case of a piston/liner arrangement as disclosed in German Offenlegungsschrift 36 07 420 A1, the latter process is utilized, wherein lubricant is fed through the wall section at high pressure via a porous portion of the cylinder liner,.

U.S. Pat. No. 4,846,051 and EP 0 330 323 A2 propose so-called lubricating oil-free internal combustion engines in which the lubrication system for the respective piston/liner arrangement contains a pressurized gas film between the piston skirt and the cylinder liner. This gas film is preferably bounded axially by means of a graphite-containing solid lubricant structure which is arranged in annular fashion on the piston skirt and/or the cylinder liner and is pressed radially into the gap between the piston skirt and the cylinder liner by a flexible material situated behind it. In this arrangement, axial depressions are provided to allow the controllable passage of gas in the axial direction.

In an article by K. Raj and R. Moskowitz, entitled "Commercial Applications of Ferrofluids", Journal of Magnetism and Magnetic Materials 85 (1990), page 233, the use of so-called ferro fluids for the purpose, inter alia, of forming lubricating films in bearings for disc storage units in computers, for example, is described.

It is the principal object of the present invention to provide a piston/liner arrangement which has a reliable and maintenance-free independent lubrication system with a long life.

SUMMARY OF THE INVENTION

In a piston/liner arrangement for a reciprocating-piston internal combustion engine, wherein a piston with a skirt is axially movable in the liner, at least one of the piston skirt and the liner includes sections with an open-pore surface structure in which a lubricant with a high affinity to the material having the open-pore surface structure is disposed so as to form a lifetime lubrication arrangement.

In this piston/liner arrangement, lubrication takes place autonomously by means of a lubricant which is stored as a lifetime lubricant in the open-cell surface structure. The open-cell surface structure provides for the release of the stored lubricant in a metered manner into the friction gap between the piston skirt and the cylinder liner.

In a particular piston/liner arrangement, sections with an open-cell surface structure, containing the stored lubricant, and pore-free, smooth-surfaced sections alternate in the axial direction on the piston skirt and/or on the cylinder liner. In this way, the porous configuration of the pistonskirt and/or cylinder-liner surface is interrupted in the axial direction of the piston by smooth-surface sections as such an arrangement favors the formation of a hydrodynamic film of lubricant in the gap between the piston skirt and the cylinder liner.

In a particular embodiment of the invention, a ferro fluid is provided as the lubricant. To retain the latter in the axial direction, annular permanent magnets are arranged around of the sections with the open-pore surface structure in which the ferro fluid is contained.

A preferred embodiment of the invention is illustrated in the drawings and is described below:

DESCRIPTION OF A PREFERRED EMBODIMENT

Figure 1:
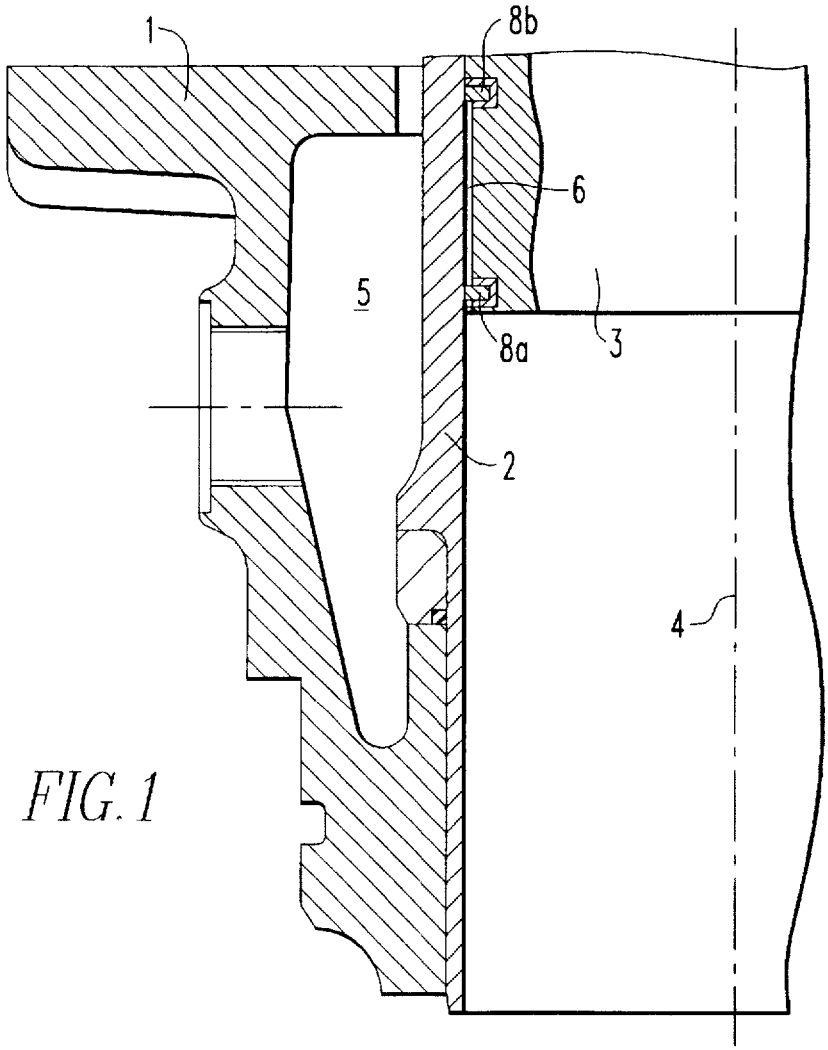
FIG. 1 shows a half of a longitudinal cross-section through a piston/liner arrangement for a reciprocating-piston internal combustion engine.

The piston/liner arrangement illustrated in FIG. 1 comprises a cylinder liner 2 which is inserted into an engine cylinder block 1 and in which a piston, of which only the piston skirt 3 is represented, is guided in an axially movable fashion along a stroke axis 4. The cylinder liner 2 can be cooled on its radial outside, for which purpose it is surrounded in a conventional manner by a corresponding cooling chamber 5.

The piston/liner unit has an autonomous lubrication system and is therefore suitable for an oil-free engine or, in any event, an engine which does not require an oil change. For this purpose, a ferro fluid 6 is provided in the friction gap 7 between the friction partners comprising the piston skirt 3 on the one hand, and the cylinder liner 2 on the other, as illustrated in greater detail in FIG. 2. As can be seen from FIG. 1, the ferro fluid lubricant 6 is bounded axially at both ends by respective permanent magnets **8*a*, 8*b*, which are disposed in associated recesses in the piston skirt 3**.

Figure 2:
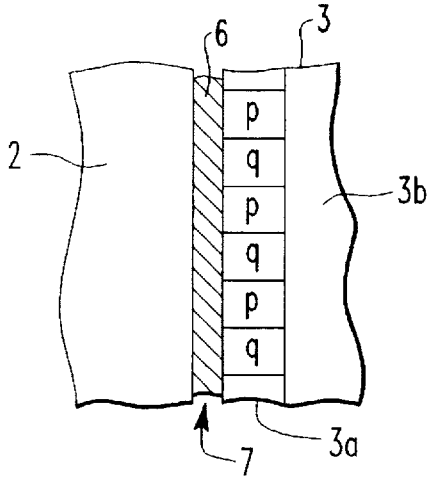
FIG. 2 shows in a partial detail view of the pistonskirt/cylinder-liner friction pair of the piston/liner unit shown in FIG. 1.

In the axial region between the two permanent-magnet rings **8*a*, 8*b* bounding the ferro fluid, the piston skirt 3 is, as illustrated in FIG. 2, constructed from a radially inner carrier body 3*b* and a surface layer 3*a* adjoining the friction gap 7. As indicated schematically in FIG. 2, this surface layer 3*a* comprises sections (g) with an open-cell surface structure, on the one hand, and sections (p) with a pore-free smooth-surface structure on the other, the two different types of surface-layer sections (g, p) alternating in the axial direction as respective annular sections. In the open-pore sections (g) there is a sufficient quantity of the ferro fluid 6** stored which is used as a lifetime lubricant. This ferro fluid has a high affinity for the material of which these open-cell sections (g) consist. It has been found that at least some of the materials customary for piston skirts are suitable for retaining, with a high affinity, conventional ferro fluid materials suitable as lubricants.

The sections (g) with the open-cell surface structure release the ferro fluid material into the friction gap 7 in a metered manner in the respective quantity required for lubrication. The smooth surface of the intermediate pore-free sections (p) insures that the surface of the piston skirt is not continuously porous in the axial direction, as this would make the build-up of a hydrodynamic lubricating film from the ferro 25 fluid lubricant 6 more difficult. Instead, the porous annular regions of the open-pore sections (g) alternate with the smooth-surface annular regions of the pore-free sections (p). This favors the formation of a hydrodynamic lubricating film from the ferro fluid lubricant 6 that fills the friction gap 7 throughout. The axial length of the sections with an open-pore surface structure is matched in a suitable manner to that of the pore-free, smooth-surfaced sections (p) which alternate with them in such a way that, on the one hand, a sufficient quantity of ferro fluid lubricant can be held in reserve and, on the other hand, the build-up of a continuous hydrodynamic ferro fluid lubricating film in the friction gap is insured.

The piston/liner unit shown is thereby provided with an autonomous lubrication system which does not require any maintenance during a typical engine service life since a sufficient quantity of ferro fluid is stored in the sections (g) with an open-pore surface structure. The ferro fluid is released in a metered manner to the friction gap 7 during operation, making this piston/liner arrangement suitable for a reciprocating-piston internal combustion engine without a lubricating-oil circuit. It is self-evident that, when required, the sections with an open-pore surface structure and a ferro fluid lubricant stored therein can be provided also on the cylinder liner 2 as an alternative, or in addition, to the arrangement shown, where the open-pore surface structures are on the piston skirt.

What is claimed is:

1. Piston/liner arrangement for a reciprocating-piston internal combustion engine comprising a cylinder liner and a piston with a piston skirt axially movably supported in said cylinder liner and forming a friction pair and a lubrication system for the friction pair formed by the piston skirt, on the one hand, and by the cylinder liner, on the other hand, at least one of said piston skirt said cylinder liner having, at least in certain sections, an open-pore surface structure in which a lubricant with a high affinity for the material of said open-pore surface structure is disposed so as to form a life-time lubrication structure.

2. A piston/liner arrangement for a reciprocating-piston internal combustion engine comprising a cylinder liner and a piston axially movably supported in said cylinder liner and forming a friction and a lubrication system for the friction pair formed by the piston skirt, on the one hand, and by the cylinder liner, on the other hand, at least one of said piston skirt said cylinder liner having at least in certain sections an open-pore surface structure comprising a material with a high affinity to a lubricant disposed in said open-pore surface structure so as to form a lifetime lubrication said lubricant being a ferro fluid captured in said open pore surface structure, and said open pore surface structure being bounded in the axial direction at opposite ends by annular permanent magnets which are integrated into the piston skirt and said cylinder liner.

* * * * *